United States Patent [19]

Hill et al.

[11] Patent Number: 4,544,086

[45] Date of Patent: Oct. 1, 1985

[54] ORNAMENT INCLUDING AUTOMATIC AND ADJUSTABLE VALVING MECHANISM

[75] Inventors: James J. Hill, Plantation; Al Marven, Hollywood, both of Fla.

[73] Assignee: Cook International, Inc., Palm Beach, Fla.

[21] Appl. No.: 485,324

[22] Filed: Apr. 15, 1983

Related U.S. Application Data

[63] Continuation-in-part of Ser. No. 443,161, Nov. 19, 1982, Pat. No. 4,469,255.

[51] Int. Cl.[4] ..... B05B 7/04

[52] U.S. Cl. ..... 222/649; 222/78; 222/113; 222/182

[58] Field of Search ..... 222/638, 639, 644, 645, 222/649, 206, 207, 212, 213, 394, 402.14, 477, 491, 494, 78, 113, 173, 182–183, 402.15; 137/624.14, 624.5, 624.2; 428/11, 13

[56] References Cited

U.S. PATENT DOCUMENTS

| | | | |
|---|---|---|---|
| 3,388,834 | 6/1968 | Hart | 222/649 |
| 3,400,263 | 9/1968 | Yakim | 428/11 X |
| 3,477,613 | 11/1969 | Mangel | 222/645 |
| 3,589,562 | 6/1971 | Buck | 222/649 |
| 3,722,749 | 3/1973 | Ishida | 222/61 |
| 3,841,525 | 10/1974 | Siegel | 222/649 |
| 3,848,775 | 11/1974 | Possell | 222/649 |
| 3,945,568 | 3/1976 | Bychowski | 239/57 |
| 4,006,844 | 2/1977 | Corris | 222/649 |

*Primary Examiner*—Joseph J. Rolla

*Assistant Examiner*—Michael S. Huppert

*Attorney, Agent, or Firm*—Oblon, Fisher, Spivak, McClelland & Maier

[57] ABSTRACT

An automatic and adjustable valving mechanism in which a spray of pressurized fluid from an aerosol can, is released in intermittent sprays occurring in cycles of adjustable length. The valving mechanism consists of a body having an actuating bar mounted on drive rods which can be latched in an elevated position by a latch plate. Contact between the actuating bar and the nozzle of a pressure source, such as an aerosol can, releases pressurized fluid from the aerosol can into a first internal chamber of the valving mechanism. The pressurized fluid acts upon a diaphragm to force hydraulic fluid from the first chamber into a second chamber, which raises a piston which, in turn, raises the rods supporting the actuating bar, to terminate the discharge of the pressurized fluid from the aerosol can. The raising of the drive rods supporting the actuating bar permits a latch plate to lock the drive rods in an elevated position while a sufficient transfer of hydraulic fluid from the first chamber to the second opens a discharge conduit for the valving mechanism. A release of the pressurized fluid from the valving mechanism permits the piston rod to drop and disengage the latch plate from the drive rods so that the actuating bar can again contact the aerosol can nozzle for initiating a further cycle. In one embodiment, the aerosol can contains a pine tree scent and the valving mechanism, as well as the aerosol can are mounted within a lighted ornament which may be attached to an artificial Christmas tree.

26 Claims, 12 Drawing Figures

ORNAMENT INCLUDING AUTOMATIC AND ADJUSTABLE VALVING MECHANISM

BACKGROUND OF THE INVENTION

The present invention is a continuation-in-part of U.S. application Ser. No. 443,161, filed on Nov. 19, 1982, now U.S. Pat. No. 4,469,255.

1. Field of the Invention

This invention relates to non-electrical pressure operated automatic and adjustable valving devices for the remote and/or automatic release of gases and/or liquids from pressurized containers or systems, such as aerosol containers or other pressurized liquid and/or gas tanks which include control gates. More particularly, this invention relates to a Christmas tree ornament including such a valving device.

2. Brief Description of the Prior Art

It is often necessary to provide automatic regulated release of pressurized fluid from a pressurized container. For example, it may be desirable to automatically release a scented aerosol from an aerosol can in predetermined quantities, and at predetermined intervals. Previously known devices for automatically releasing fluid from pressurized vessels were complicated in design and construction, resulting in high cost, low reliability, excessive size and weight and servicing difficulties. This rendered them generally commercially unacceptable.

The present invention overcomes the above disadvantages of the prior art and provides a commercially acceptable product which is simple in construction, inexpensive to produce, small in size, light in weight, reliable in operation and easily servicable.

SUMMARY OF THE INVENTION

A principal object of the present invention is the provision of a valving mechanism capable of unattended and remote actuating of the on-off gate valve mechanism of a pressurized line or container, such as the gate valve mechanism of an aerosol can.

Another object of the invention is the provision of a valving mechanism which is operated by the pressure of the fluid being released by the valving mechanism.

A further object of the invention is the provision of a valving mechanism which can accurately and adjustably control the length of the dispersing period and the length of the cycles between the dispensing periods.

A further object of the invention is the provision of a valving mechanism which is reliable, inexpensive, small in size, light in weight, adjustable and readily and quickly connectable to a source of pressurized fluid.

Another object of the invention is to provide an artificial Christmas tree ornament which sprays a pine tree fragrance in the area of the tree.

Another object of the present invention is to provide a lighted Christmas tree ornament.

According to the invention, a spray of pressurized fluid from a pressurized source having a pressure release gate, such as an aerosol can, is released in intermittent sprays occurring in cycles of adjustable length. The valving mechanism consists of a body having an actuating bar mounted on drive rods which can be latched in an elevated position by a latch plate. Contact between the actuating bar and the nozzle of a pressure source, such an an aerosol can, releases pressurized fluid from the aerosol can into a first internal chamber of the valving mechanism. The pressurized fluid acts upon a diaphragm to force hydraulic fluid from a first chamber into a second chamber, which has the effect of raising a piston which, in turn, raises the rods supporting the actuating bar, so that the discharge of the pressurized fluid from the nozzle of the aerosol can is terminated. The raising of the drive rods supporting the actuating bar permits a latch plate to lock the drive rods in an elevated position while a sufficient transfer of hydraulic fluid from the first chamber to the second opens a discharge conduit for the valving mechanism. A release of the pressurized fluid from the valving mechanism permits the piston rod to drop and disengage the latch plate from the drive rods so that the actuating bar can again contact the aerosol can nozzle for initiating a further cycle.

According to a second embodiment of the invention, the pressurized source is an aerosol can and the pressurized fluid is a pine tree fragrance. The valving mechanism and the aerosol can are supported in a bracket mounted within a Christmas tree ornament. A fluid conduit extends from the valving mechanism to the exterior of the ornament for supplying the pine tree fragrance to the exterior of the ornament. Such an ornament is particularly useful for artificial Christmas trees. The ornament may be partially translucent and may be provided with interior lighting.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 3:
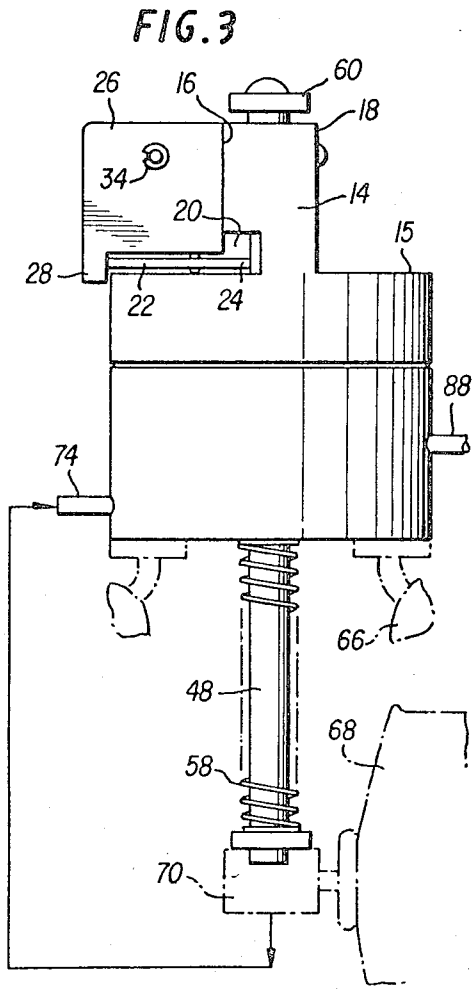
FIG. 3 is a side view of the assembled valving mechanism.
Figure 2:
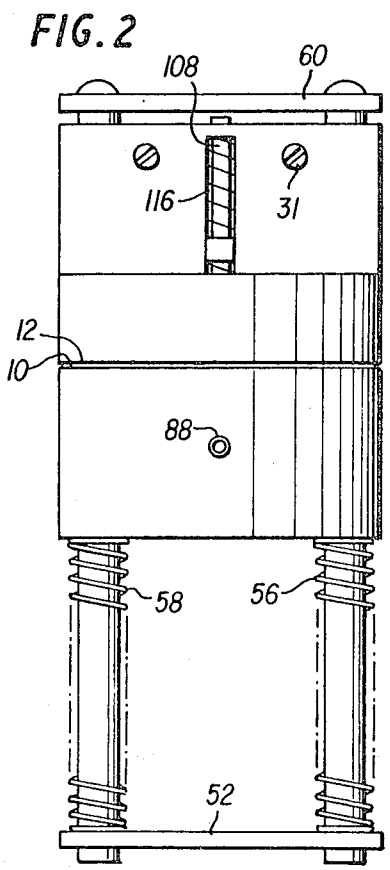
FIG. 2 is a rear view of the assembled valving mechanism.
Figure 1:
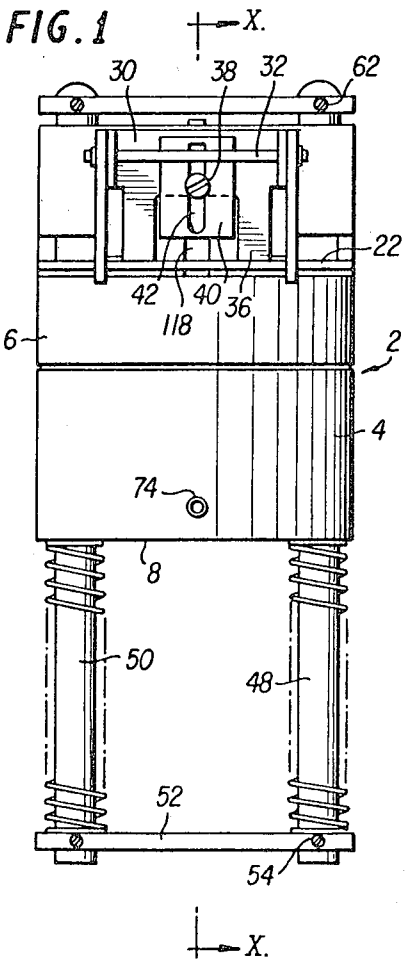
FIG. 1 is a front view of the assembled valving mechanism.
Figure 4:
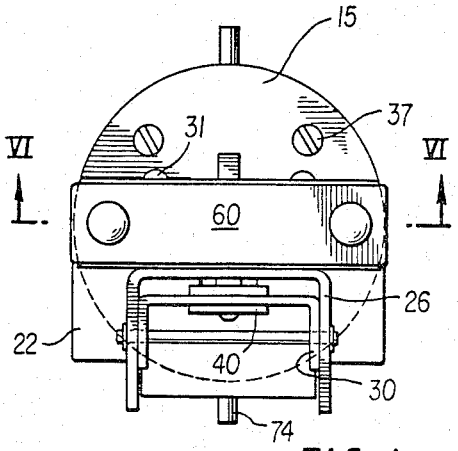
FIG. 4 is a top view of the assembled valving mechanism.
Figure 5:
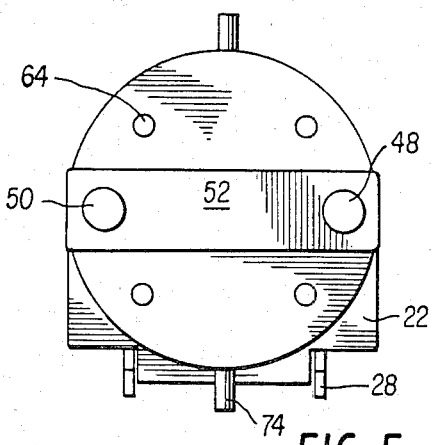
FIG. 5 is a bottom view of the assembled valving mechanism.

The preferred embodiments of the present invention will now be described with reference to the attached figures in which the same elements are referred to by the same reference numerals throughout the several views.

Referring to FIGS. 1–5 and 10, the adjustable valving mechanism is enclosed within a hollow housing 2 defined by a base 4 and an upper body 6 which are assembled to form the housing 2 by engaging corresponding mating surfaces of the base and upper body portions.

The base 4 is preferably cylindrical with a flat bottom surface 8 and a top surface 10. The upper body 6 is also preferably cylindrical with a bottom surface 12 in sealing contact wiith the surface 10 of the base 4. Screws 31 securely hold the upper body and base together to forma single housing 2.

The upper portion of the upper body is formed as an extending semi-cylindrical extension 14 extending from the top surface 15 of said upper body. The front and rear of the extension 14 are defined by flat axial surfaces 16 and 18. The front axial surface 16 is provided with a transverse notch 20 which extends across the entire width of the projection 16.

Latch plate 22 is positioned above, and parallel to, the front portion of the top surface 15. One end 24 of the latch plate 22 extends into the notch 20. A latch bracket 26 is mounted to the projection 16 by screws 30 and includes legs 28 which can abut one end of the latch plate 22. The latch bracket 26, the latch bracket legs 28, the top surface 15 and the notch 20 together form a channel for holding the latch plate 22 and permitting the latch plate 22 to move into and out of the notch 20.

A latch lever 30 is pivotably mounted to the latch bracket 26 via rod 32 journalled in apertures of the latch bracket and latch lever. The rod 32 is preferably held in place by rings 34.

The latch lever 30 includes a pair of legs 36 which extend downward and through corresponding apertures 37 (FIG. 10) in latch plate 22. Therefore, the pivoting of the latch lever 30 about the latch rod 32 causes the latch plate 22 to move parallel to the top surface 15 between two extreme positons defined by the vertical edge of the notch 20 and the legs 28 of the latch bracket 26.

A latch adjustment screw 38 is threadably mounted on the latch lever 30 and adjustably supports a latch adjusting plate 40 having a slot 42. The latch adjusting plate 40 can be adjusted in the axial direction by relative sliding between the screw 38 and the slot 42.

A pair of drive rod channels 44 and 46 (FIG. 6) are formed by pairs of coaxial bores in the base 4 and upper body 6. Drive rod channels 44 and 46 intersect the notch 20. Drive rods 48 and 50 are axially movably supported within the channels 44 and 46. An actuating bar 52 is connected to the bottom ends of the rods 48 and 50 and can be adjustably secured along the length of the rods by use of set screws 54. A pair of compression springs 56 and 58 are mounted on the rods 48 and 50 and are compressed between the actuating bar 10 and the bottom surface 8 of the base for biasing the rods downward. The downward movement of the rods 48 and 50 is limited by timing bar 60, mounted on the rods 48 and 50 at the tops thereof, and adjustably positioned along the lengths of the rods 48 and 50 by set screws 62.

Holes 64 on the bottom surface 8 are used for mounting the valving mechanism to brackets 66 of an enclosure (not shown). An aerosol can 68 is also mounted within the enclosure and position relative to the valving mechanism such that the nozzle or gate mechanism 70 of the aerosol can is tilted by the actuating bar 52 for releasing pressurized fluid from the aerosol can when the rods 48 and 50 are biased fully downwards by the springs 56 and 58, as seen in FIG. 3. A tube 72 connects the nozzle 70 of the aerosol can to the input tube 74 of the valving mechanism.

Referring particularly to FIGS. 7–10, the base and upper body of the valving mechanism are hollow. The hollow interior of the valving mechanism is divided into three chambers 76, 78 and 80 by flexible elastomeric membranes 82 and 84. The peripheries of the membranes 82 and 84, as well as the periphery of a valve body 86 are clamped within the valving mechanism by shoulders defined on the surfaces 10 and 12 of the base 4 and the upper body 6. The input tube 74 communicates with the bottom of the chamber 76 and an output tube 88 communicates with an upper portion of the chamber 76 and extends through the base 4 for connecting to a conventional spray nozzle which discharges to the atmosphere.

Figure 7:
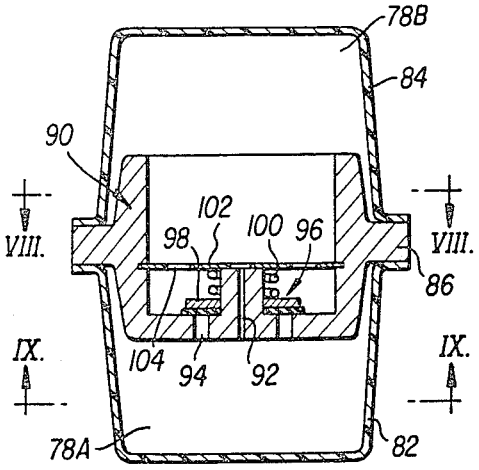
FIG. 7 is a detail, also in section, of the valve body assembly of FIG. 6.
Figure 8:
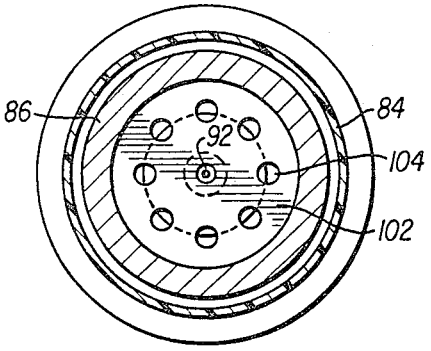
FIG. 8 is a view of the valve body assembly as seen in section along the plane VIII—VIII in FIG. 7, but with the diaphragm removed.
Figure 9:
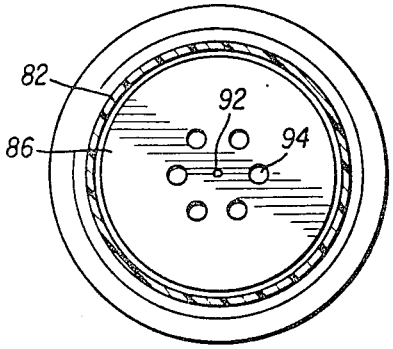
FIG. 9 is a view similar to that of FIG. 8, but seen along plane IX—IX.

The valve body assembly 90, including the valve body 86 is shown in detail in FIGS. 7–9. As can there be seen, the chamber 78 defined by the diaphragms 82 and 84 is divided into two subchambers 78A and 78B by the valve body 86. The subchambers communicate with one another via an axial metering bore 92 in the valve body and by a plurality of orifices 94 surrounding the metering bore.

The chamber 78 contains a viscous hydraulic fluid such as oil. A one way valve 96 permits the oil to pass through the orifices 94 only from the subchamber 78*a* to the subchamber 78*b*, but not in the opposite direction. The one way valve 96 consists of a valve washer assembly 98 having an elastomeric washer element pressed against the orifices 94 by spring 100. The spring 100 also abuts against a retaining plate 102 mounted in the valve body. The retaining plate 102 includes orifices 104 to permit fluid to pass between subchambers 78*a* and 78*b*.

Figure 6:
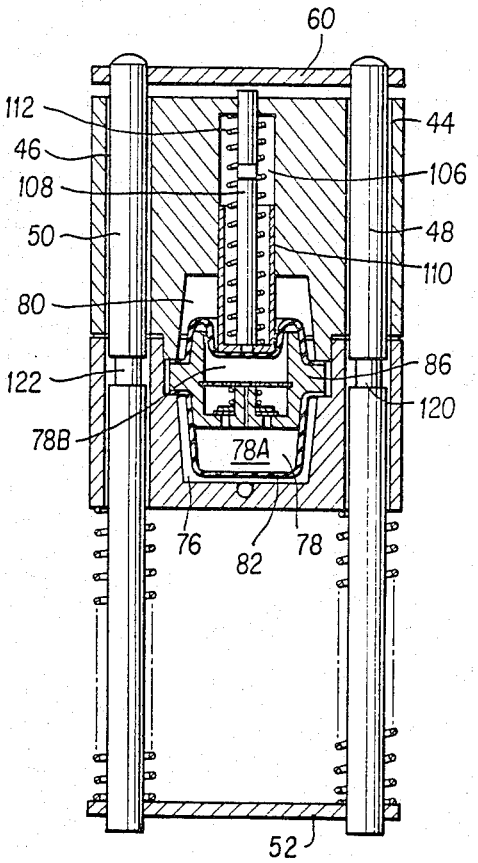
FIG. 6 is a cross section along plane VI—VI of FIG. 4.
Figure 10:
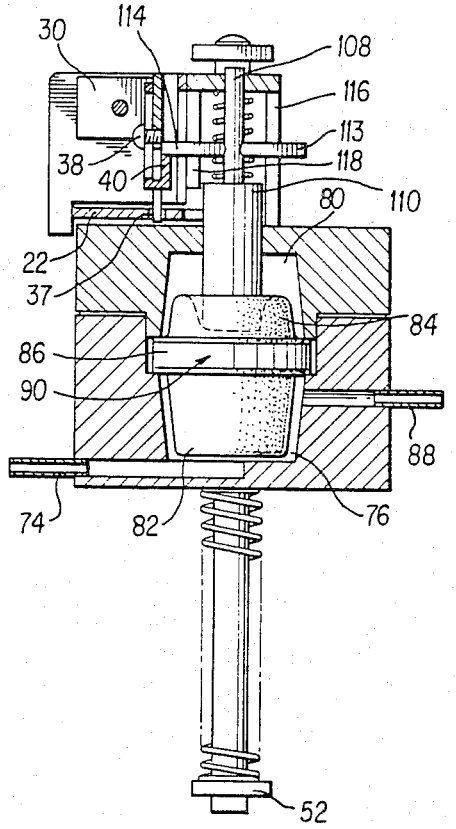
FIG. 10 is a sectional view seen along plane X—X of FIG. 1.

As best seen in FIGS. 6 and 10, the chamber 80 includes an extension 106 which extends upward through the projection 14. A piston rod 108 whose bottom is surrounded by a piston 110 are axially movably positioned within the chamber 80 and extension 106 so that the bottom of the piston 110 is adjacent the diaphragm 84. A spring 112 biases the piston and piston rod downward against the diaphragm 84.

As best seen in FIG. 10, the piston rod 108 includes a pair of transverse tabs 112 and 114 which extend transversely through axial slots 116 and 118 of projection 14 so that the tab 114 can engage a portion of the latch adjustment plate 40 during axial movement of the piston rod 108.

As best seen in FIG. 6, the rods 48 and 50 are provided with annular grooves 120 and 122. Alternatively, the grooves 120 and 122 could be in the form of slots on the rods 48 and 50, said slots oriented towards the front of the valving mechanism (that is, towards the latch plate 22). The grooves are axially positioned on the rods 48 and 50 such that they are below the axial position of the latch plate 22 when the rods are in the position shown in the Figures. However, if the rods are moved upward, against the biasing of springs 56 and 58, the grooves 120 and 122 are moved upward to a position where they are exposed by the notch 20 and in which the latch plate 22 can be inserted into the grooves.

In use, the container supporting the valving mechanism and aerosol can is positioned so that the axis of the valving mechanism is horizontal and so that the aerosol can is vertical. That is, the orientation of the valving mechanism shown in the figures is rotated 90° in the plane of the figures so that the latch bracket 26 is at the top of the mechanism (although the specification will refer to upward or downward movement of several elements, it is to be recognized that in use such movement will be horizontal). As a result of this orientation, the weight of the latch plate 22 causes it to move into the notch 20 until the end 24 of the latch plate 22 abuts against the rods 48 and 50. Moreover, the weight of the oil or hydraulic fluid within the chamber 78 causes the diaphragm 82 to press against the opening of the output tube 88 and seal said output tube.

In the illustrated configuration, the spring 112 has forced the piston 110 and piston rod 108 downward towards the diaphragm 84 and forced the diaphragm 84 towards the valve body so that the subchamber 78B has a minimum volume (FIGS. 6 and 10). The actuating bar 52 is then pressing on, and opening, the nozzle 70 of the aerosol can. Therefore, pressurized fluid from the aerosol can is released through the nozzle 70 and the tube 72 to the input conduit 74, and from there into the chamber 76. The pressurized fluid within the chamber 76 forces the hydraulic fluid in subchamber 78A through the orifices 94 and the metering bore 92 into the subchamber 78B. However, the pressurized fluid in the chamber 76 is not initially discharged through the output tube 88 since its outlet into chamber 76 is blocked by the diaphragm 82. As the hydraulic is forced into subchamber 78B, the diaphragm 84 moves axially towards the piston 110 and acts as a hydraulic piston which forces the piston rod 108 into contact with the timing bar 60, while compressing the spring 112.

Continuing expansion of the subchamber 78B causes the piston 108 to raise the timing bar 60, and with it the drive rods 48 and 50, as well as the actuating bar 52. As the drive rods 48 and 50 rise, the grooves 120 and 122 move into the notch 20 and the latch plate 22 falls, by its own weight, into the grooves 120 and 122, thus locking the position of the drive rods. At about the same time, the diaphragm 82 has contracted, due to the gas pressure in chamber 76, to the extent that the output tube 88 is exposed and a spray of pressurized fluid is discharged to an output nozzle. Moreover, the upward movement of the drive rods 48 and 50 has disengaged the actuating bar 52 from the nozzle 70 of the aerosol can so that the introduction of pressurized gas into the chamber 76 from the aerosol can is terminated.

Therefore, the pressure chamber 76 which has forced the subchamber 78A to contract, is released.

At this time, the biasing force of spring 112 forces the piston and piston rod, while in contact with the diaphragm 84, downward towards the valve body 86. This has the effect of compressing the subchamber 78B. However, because of the one way valve 96, the hydraulic fluid is not able to return to the subchamber 78A via the orifices 94. Instead, the hydraulic fluid can only return to subchamber 78A via the metering bore 92, thereby delaying the transfer of fluid from the subchamber 78B to the subchamber 78A. Although the piston rod 108 moved downward, the drive rods 48 and 50 do not move downward under the biasing action of springs 56 and 58 because of the engagement between the latch plate 22 and the grooves 120 and 122. Therefore, the actuating bar 52 does not immediately again contact the aerosol can nozzle 70, and there is accordingly a delay before the beginning of the next spraying cycle.

During this period, hydraulic fluis is slowly passing through the metering bore 92 at a controlled rate under the biasing action of spring 112 which forces the piston 110 against the diaphragm 84. As the hydraulic fluid is forced from subchamber 78B to subchamber 78A, the piston 110 and piston rod 108 are able to move further downward, as do the tabs 114 and 116. Eventually, the tab 114 will contact the latch adjusting plate 40. Continued downward movement of the tab 114 will cause the latch adjustment plate 40, as well as the attached latch lever 30, to pivot about rod 32 in the clockwise direction. This will have the effect of moving the latch plate 22 to the left in FIG. 10 (upward in actual operation since the axis of the valving mechanism will be horizontal), until the edge 24 of the latch plate 22 moves out of the grooves 120 and 122. The disengagement of the latch plate from the grooves 120 and 122 will permit the springs 56 and 58 to force the drive rods 48 and 50, as well as the actuating bar 52, against the nozzle 70 of the aerosol can, thus beginning a new cycle.

The adjustability of both the length of the spray period and the timing between spray cycles can be accomplished as follows. The length of the spray period depends upon the length of time during which the actating bar 52 is in contact with the nozzle 70. This depends upon both the position of the actuating bar 52 on the rods 48 and 50, and upon the position of the timing bar 60 on said rods (since the raising of the actuating rod 52 is performed by the piston rod 108 raising the timing bar 60). Therefore, by adjusting the positions of these bars on the drive rods 48 and 50, one can select a desired spray period. The length of the cycles depends upon the timing of the disengagement of the latch plate 22 from the grooves 120 and 122. This is, in turn, a function of the position of the latch adjusting plate 40 and the size of the metering bore 92, since the metering bore 92 controls the rate at which the piston rod 108, and the tab 114, can descend. Therefore, the timing of the cycles can be fine tuned by adjusting the position of the latch adjusting plate 40 on the latch lever 30. As a result, the apparatus of the present invention provides an automatic spray actuating device which can be easily adjusted both for the length of the spray and for the timing of the spraying cycles.

Figure 12:
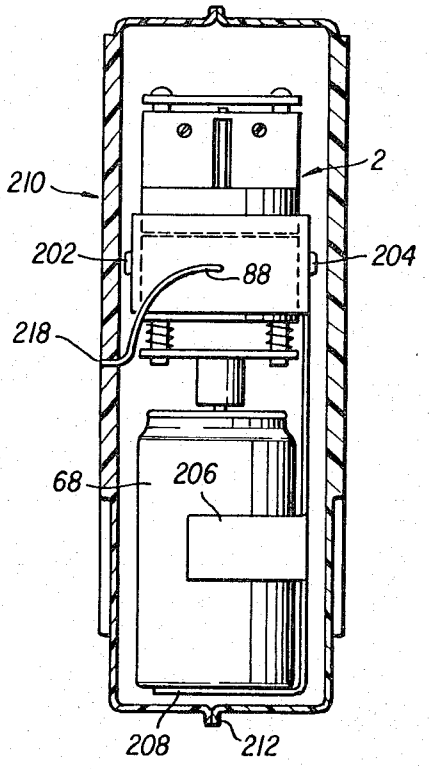
FIG. 12 is a side view, also partially cut-away, of the embodiment of FIG. 11.
Figure 11:
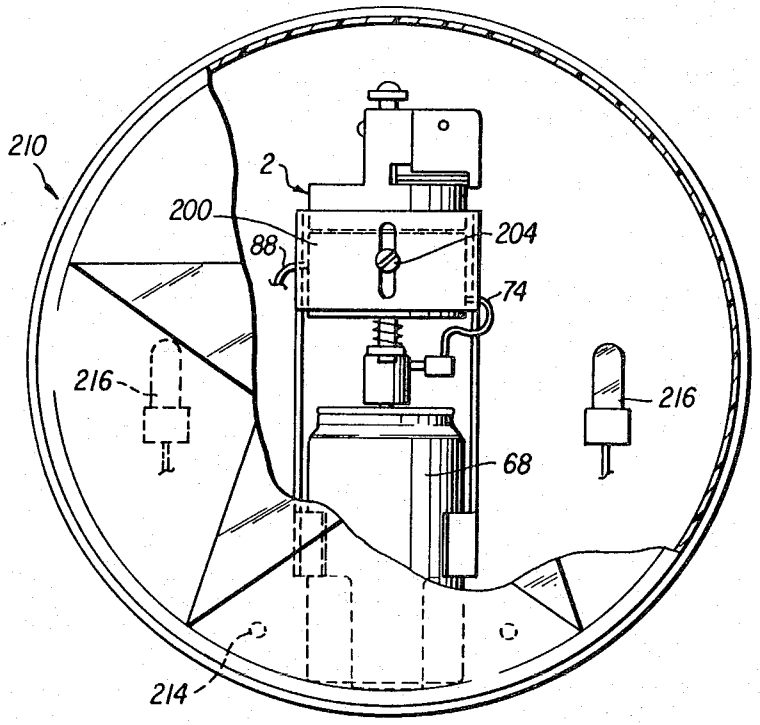
FIG. 11 is a front elevational view, partially cut-away, of the second embodiment of the present invention.

The valving mechanism of the present invention is adaptable to several environments. For example, an important shortcoming of artificial Christmas trees is a lack of a natural tree scent. The present invention is useful to provide a timed intermittent release of pine tree fragrance to the area surrounding the artificial Christmas tree. In the embodiment of FIGS. 11 and 12, the valving mechanism housing 2 and the aerosol can 68 are mounted in a frame 200. The housing 2 is bolted to the frame 200 at 202 and 204. However, the aerosol can is not bolted to the frame but is held in place by the elasticity of gripping arms 206 of the frame. The frame can be formed of sheet metal or resilient hard plastic.

The orientation of the valving mechanism and the aerosol can differs from that of the previous embodiment in that the aerosol can 68 is positioned so that its valve 70 is pressed downwardly by the actuating bar 52. For these reasons, the frame includes a bottom support 208 for the aerosol can, so that the aerosol can is not pressed downward by the actuating bar. The valving mechanism and aerosol can may be oriented horizontally, if desired.

The frame 200, including the valving mechanism and aerosol can supported therein, is bolted, or otherwise secured, to a hard plastic cover forming the Christmas tree ornament. In the disclosed embodiment, the cover is in the form of a short cylinder or disk, however it may be appreciated that the cover may have any desired shape. According to the disclosed embodiment, the cover is formed of a hard plastic. A star decoration with a translucent background may be formed on either side of the cover. The cover is preferably formed in two halves having mating flanges 212 which may snap together using any desired securing means, such as molded detents molded into the cover itself.

The cover can include holes 214 in one, or both sides, for the attachment of a bracket which can be used to secure the ornament to a Christmas tree.

Lamps 216 may be provided in the ornament for lighting the interior of the ornament. Since the background portion of the cover is translucent, this highlights the shape of the cover design, such as the star.

The outlet tube 88 of the valving mechanism extends to the opening 218 in the center of the cover for supplying the pine tree fragrance to the exterior of the cover, and thus providing the artificial Christmas with a pine tree fragrance.

The valving mechanism itself operates in the manner of the previously described embodiment.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An automatic and adjustable valving mechanism for the timed release of pressurized fluid from an output valve of a pressurized fluid source, said valving mechanism comprising:

a housing having an axis;

actuating means on said housing and movable into contact with said output valve in a first position for releasing pressurized fluid from said fluid source;

first biasing means for biasing said actuating means into said first position;

fluid pressure means in said housing for moving said actuating means from a first position to a second position wherein said actuating means and said output valve are not in contact;

means for communicating said pressurized fluid released from said fluid source with fluid pressure means for actuating said fluid pressure means;

first adjustment means for adjusting the timing of said actuating of said fluid pressure means;

latch means on said housing for latching said actuating means in said second position;

first release means in said housing for releasing and discharging said pressurized fluid from said fluid pressure means;

second release means in said housing for releasing the latching of said actuating means by said latch means;

second adjustment means for adjusting the timing of actuation of said second release means;

support means for supporting said pressurized fluid source in a fixed position relative to said valving mechanism; and a plastic cover to which said support means is secured and housing said valving mechanism and said pressurized fluid source.

2. The mechanism of claim 1 wherein said fluid pressure means comprise:

first and second diaphragms in said housing, said diaphragms dividing the interior of said housing into three axially spaced chambers, a first of said chambers defined in part by said first diaphragm including said means for communicating, a second of said chambers being positioned between said diaphragms, and a third of said chambers being defined in part by said second diaphragm;

a valve body in said second chamber, said valve body dividing said second chamber into a first subchamber defined by said valve body and said first diaphragm, and a second subchamber defined by said valve body and said second diaphragm;

hydraulic fluid in said second chamber;

aperture means in said valve body permitting said hydraulic fluid to communicate between said first and second subchambers; and piston means positioned in said third chamber and movable in an axial direction and in contact with at least one of said second diaphragm and said actuating means, whereby the introduction of said pressurized fluid from said means for communicating into said first chamber causes a portion of said hydraulic fluid to be transferred from said first subchamber to said second subchamber, whereby said second diaphragm moves said piston means so as to move said actuating means from said first position to said second position.

3. The mechanism of claim 2 wherein said aperture means comprises:

a metering bore in said valve body;

orifice means in said valve body for providing hydraulic fluid flow parallel to said metering bore; and one way valve means associated with said orifice means for preventing fluid flow through said orifice means from said second subchamber to said first subchamber.

4. The mechanism of claim 2 wherein said first release means comprises:

a transverse bore through said housing, said transverse bore defining an opening in a wall portion of said first chamber; and a first portion of said first diaphragm positioned so as to seal said opening exceptt when said portion of said hydraulic fluid has been transferred from said first subchamber to said second subchamber.

5. The mechanism of claim 1 wherein said actuating means comprises:

at least one axial bore in said housing;

a drive rod movable in each said axial bore;

actuating bar means releasably connected to one end of each said drive rod and contacting said output valve of said pressurized fluid source when said actuating means is in said first position; and timing bar means releasably connected to a second end of each drive rod and contacting said fluid pressure means.

6. The mechanism of claim 2 wherein said actuating means comprises:

at least one axial bore in said housing;

a drive rod movable in each said axial bore;

actuating bar means releasably connected to one end of each said drive rod and contacting said output valve of said pressurized fluid source when said actuating means is in said first position; and timing bar means releasably connected to a second end of each said drive rod and contacting said fluid pressure means.

7. The mechanism of claim 6 wherein said timing bar contacts said piston means.

8. The mechanism of claim 5 wherein said latch means comprises:

detent means on each said drive rod;

a latch element movable into and out of engagement with said detent means when said actuating means are in said second position; and means for moving said latch element into engagement with said detent means.

9. The mechanism of claim 6 wherein said latch means comprises:

detent means on each said drive rod;

a latch element movable into and out of engagement with said detent means when said actuating means are in said second position; and means for moving said latch element into engagement with said detent means.

10. The mechanism of claim 8 wherein said latch element comprises a plate constrained to move in a direction transverse to said axis and wherein said means for moving said latch element into engagement with said detent means comprises gravity acting upon the mass of said latch element.

11. The mechanism of claim 9 wherein said latch element comprises a plate constrained to move in a direction transverse to said axis and wherein said means for moving said latch element into engagement with said detent means comprises gravity acting upon the mass of said latch element.

12. The mechanism of claim 1 wherein said second release means is constructed so as to be actuated by said fluid pressure means.

13. The mechanism of claim 2 wherein said second release means comprises transverse arm means fixed to said piston means and a latch release element selectively engageable with said arm means and connected to said latch means.

14. The mechanism of claim 7 wherein said second release means comprises transverse arm means fixed to said piston means and a latch release element selectively engageable with said arm means and connected to said latch means.

15. The mechanism of claim 10 wherein said second release means comprises:

a latch release element pivotable about an axle connected to said housing, said latch release element being in engagement with said latch plate, whereby the pivoting of said latch release element moves said latch plate; and transverse arm means fixed to said fluid pressure means and selectively engageable with a portion of said latch release element for pivoting said latch release element.

16. The mechanism of claim 11 wherein said second release means comprises:

a latch release element pivotable about an axle connected to said housing, said latch release element being in engagement with said latch plate, whereby the pivoting of said latch release element moves said latch plate; and transverse arm means fixed to said fluid pressure means and selectively engageable with a portion of said latch release element for pivoting said latch release element.

17. The mechanism of claim 16 wherein said transverse arm means is fixed to said piston means, and said second release means includes means for biasing said piston means towards said second diaphragm.

18. The mechanism of claim 5 wherein said first adjusting means comprise means for adjusting the axial positions of said actuating bar means and said timing bar means on said drive rods.

19. The mechanism of claim 15 wherein said second adjustment means comprises means for axially adjusting the position of said portion of said latch release element.

20. The mechanism of claim 17 wherein said second adjustment means comprises means for axially adjusting the position of said portion of said latch release element.

21. The mechanism of claim 4 including:

an opening in said plastic cover; and a fluid conduit connecting said opening in said plastic cover with said opening in a wall portion of said first chamber, whereby said pressurized fluid from said valving mechanism may be discharged from said cover.

22. The mechanism of claim 1 wherein said pressurized fluid source is an aerosol can having an axis and a valve which is actuated by movement along said axis of said aerosol can, and wherein said support mechanism supports said aerosol can relative to said valving mechanism such that said axis of said aerosol can is parallel to said housing axis.

23. The mechanism of claim 22 wherein said cover is in the form of a cylinder having a cylindrical axis transverse to said axis of said housing, and wherein said opening in said cover lies on said cylindrical axis.

24. The mechanism of claim 22 wherein said cover is formed by two cylindrical halves, each of said cylindrical halves having means for securing said cylindrical halves to one another.

25. The mechanism of claim 23 wherein said cover is at least partially translucent and includes illuminating means within said cover.

26. The mechanism of claim 1 wherein said pressurized fluid includes a pine tree scent.

* * * * *